US012318702B1

(12) United States Patent
Douglas

(10) Patent No.: US 12,318,702 B1
(45) Date of Patent: Jun. 3, 2025

(54) TARGET GAME SYSTEM WITH BALL RETURN DEVICE

(71) Applicant: Andrew Murray Douglas, San Diego, CA (US)

(72) Inventor: Andrew Murray Douglas, San Diego, CA (US)

( * ) Notice: Subject to any disclaimer, the term of this patent is extended or adjusted under 35 U.S.C. 154(b) by 413 days.

(21) Appl. No.: 17/870,679

(22) Filed: Jul. 21, 2022

Related U.S. Application Data

(60) Provisional application No. 63/224,290, filed on Jul. 21, 2021.

(51) Int. Cl.
*A63F 7/34* (2006.01)

(52) U.S. Cl.
CPC ..... *A63F 7/34* (2013.01); *A63F 2007/346* (2013.01)

(58) Field of Classification Search
CPC .. A63F 7/30; A63F 7/34; A63F 7/0612; A63F 2007/345; A63F 2007/346; A63F 2007/0011
USPC ..... 273/108, 317.1, 317.3, 342, 352, 394, 273/395, 396, 397, 121 R
See application file for complete search history.

(56) References Cited

U.S. PATENT DOCUMENTS

| | | | | |
|---|---|---|---|---|
| 2,145,840 | A * | 1/1939 | Thompson | A63F 7/305 273/352 |
| 3,561,762 | A * | 2/1971 | Russell | A63F 7/0612 206/45.3 |
| 3,622,160 | A * | 11/1971 | Barfield | A63F 7/0612 124/4 |
| 5,183,253 | A * | 2/1993 | Grimaldi | A63B 69/0071 473/433 |
| 6,224,504 | B1 * | 5/2001 | Tien | A63B 63/083 473/433 |
| 2007/0045964 | A1 * | 3/2007 | Petras | A63B 63/083 273/400 |
| 2012/0032402 | A1 * | 2/2012 | Comee | A63B 67/06 273/410 |

* cited by examiner

*Primary Examiner* — Joseph B Baldori
(74) *Attorney, Agent, or Firm* — Plager Schack LLP; Mark H. Plager; Naomi Mann

(57) ABSTRACT

Disclosed is a ball return device for a target-tyle game, which may comprise a main container configured to support at least one target; top catch panels coupled to a top edge of the main container and configured to extend upwards and outwards with respect to the top edge of the main container and to create a backboard which directs a ball thrown at the backboard into the main container; and a ball return channel configured to convey balls from the main container to a player located remotely from the main container, wherein the top catch panels are configured to fold onto the main container, and wherein the ball return device is configured to pack into a compact unit.

12 Claims, 7 Drawing Sheets

TARGET GAME SYSTEM WITH BALL RETURN DEVICE

RELATED APPLICATION

This application claims benefit to U.S. Provisional Application No. 63/224,290 filed Jul. 21, 2021, which is incorporated by reference herein in its entirety.

BACKGROUND

The present disclosure relates generally to ball return devices for target games.

Target style games that use balls such as beer pong or miniature basketball require participants to retrieve the balls after a shot is made, which can be frustrating and tedious. As such, an improved ball return system for target style games is desirable.

SUMMARY

According to various embodiments, disclosed is a ball return device for a target-tyle game, which may comprise a main container configured to support at least one target; top catch panels coupled to a top edge of the main container and configured to extend upwards and outwards with respect to the main container and to create a backboard which directs a ball into the main container; and a ball return channel configured to convey balls from the main container to a player located remotely from the main container, wherein the top catch panels are configured to fold onto the main container and wherein the ball return device is configured to pack into a compact unit.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
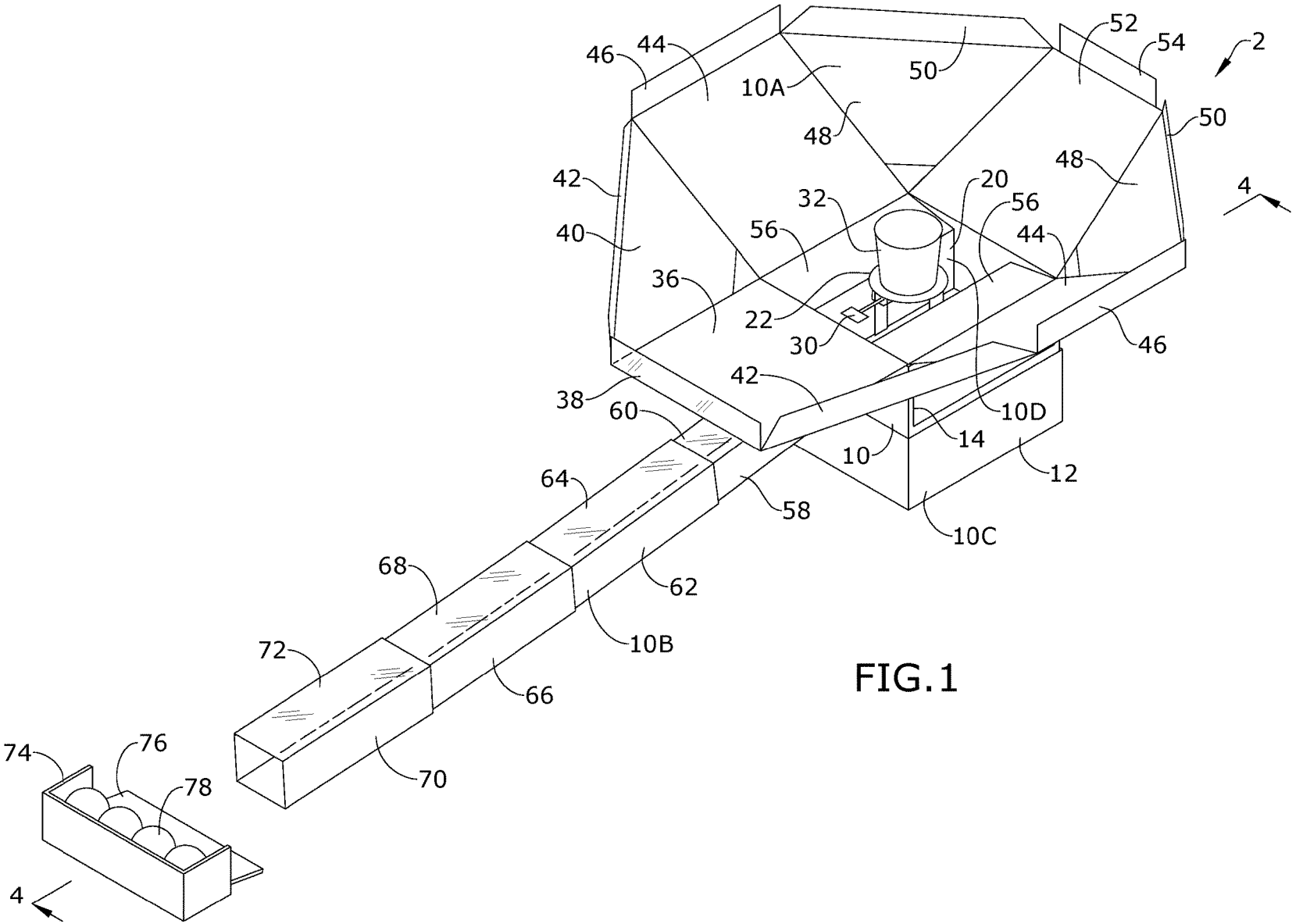
FIG. 1 is a perspective view of a foldable ball return device for a target game, according to certain embodiments.
Figure 2:
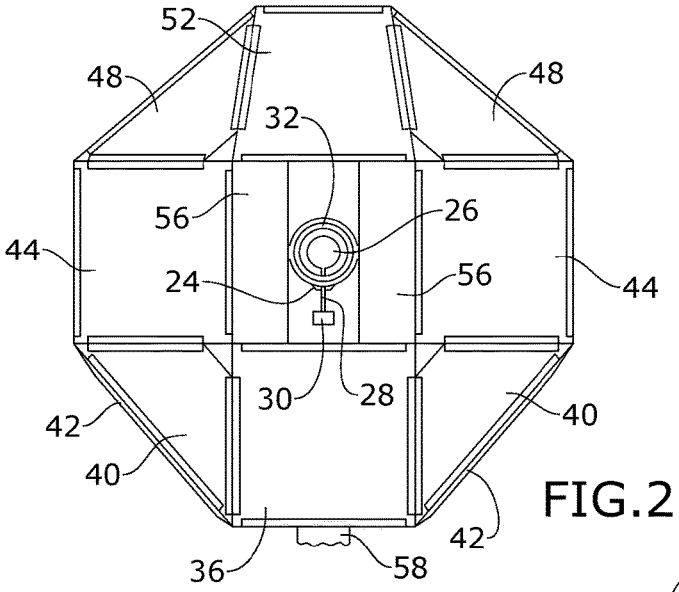
FIG. 2 is a top view of the ball return device of FIG. 1.
Figure 3:
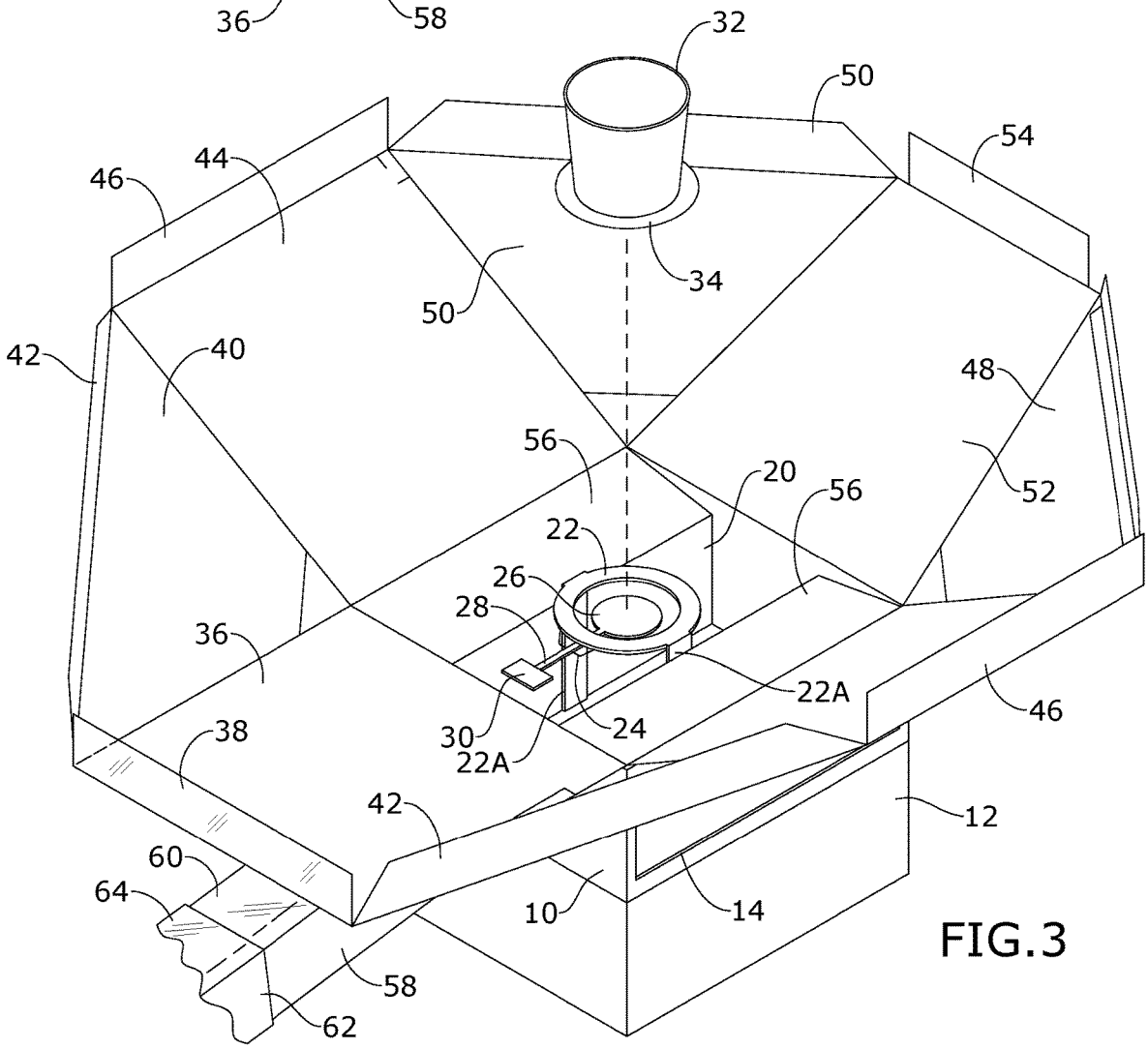
FIG. 3 is a detailed perspective view of the ball return device, wherein the target of the device is shown in exploded view.
Figure 4:
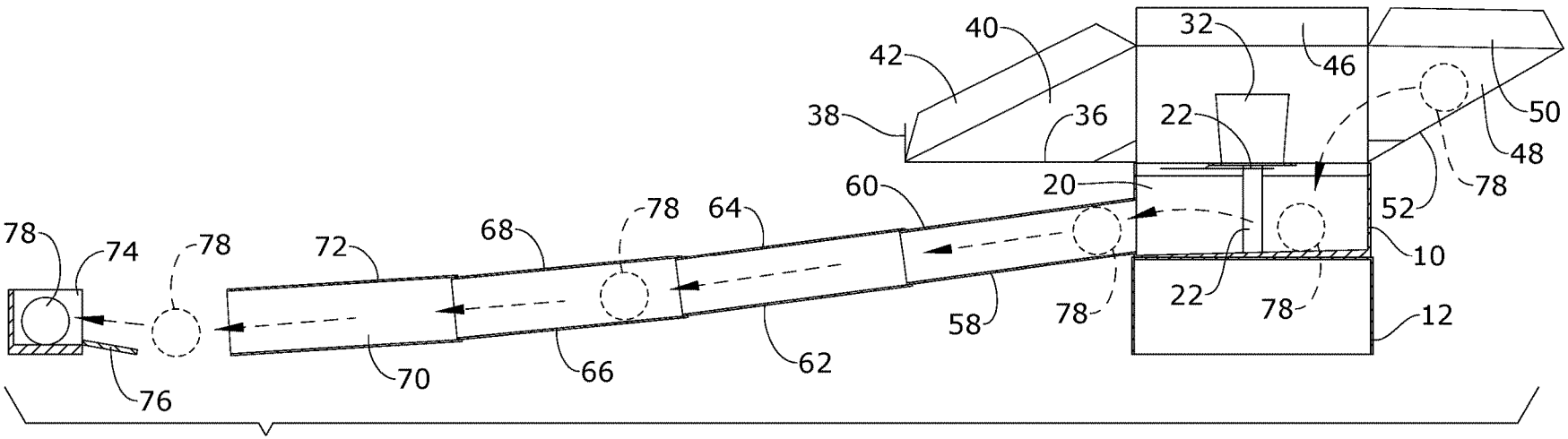
FIG. 4 is a sectional view of the ball return device, taken along line 4-4 in FIG. 1, illustrating the path of a ball missing the target and being returned through a ball return channel of the device.

According to various embodiments as depicted in FIGS. 1-12, disclosed is a foldable ball return device 2, which may be used for playing target-tyle games that use balls and targets. Such games may include, but are not limited to beer pong, miniature basketball, trick shots, ping pong practice, and the like. In certain embodiments, ball return device 2 is designed to return a ball to the throwing player for both miss and hit shots. Ball return device 2 is further configured to pack into a compact unit for convenient storage and portability. Additionally, the disclosed device may function without electricity in some embodiments.

In embodiments, ball return device 2 may generally comprise a main container 10 supporting at least one target 10D and a ball return channel 10B coupled to main container 10. Players may throw a ball 78 (such as a ping pong, miniature basketball, etc.) at ball return device 2 with the intent of hitting or landing the ball inside target 10D, wherein the thrown ball is directed from main container 10 into ball return channel 10B to roll back to a player located remotely from the main container. In certain embodiments, ball return device 2 may further comprise top catch panels 10A coupled to a top edge of main container 10. Top catch panels 10A are generally configured to direct missed balls into main container 10 wherein the balls are subsequently directed into ball return channel 10B for return to the player. In some embodiments, top catch panels 10A and ball return channel 10B are collapsible and extendable with respect to main container 10, making ball return device 2 easily packable. In certain embodiments, ball return device 2 may also be configured to store game supplies including balls 78. In further embodiments, ball return device 2 may comprise a stand 10C on which main container 10 may be supported. In one embodiment, stand 10C may also function as a lid for ball return device 2.

In one embodiment, main container 10 may be in the form of a box or rectangular prism, and may comprise a bottom wall 11, a front wall 11A, a back wall 11C, and two side walls 11B between the front and back walls. Additionally, the top catch panels are configured to create a flat square or rectangular surface on top of the main container when folded. However, it shall be appreciated that main container 10 may have different geometric configurations in alternate embodiments. In certain embodiments, main container 10 may include a duct 20 provided inside main container 10 and coupled to ball return channel 10B. Main container 10 may further include at least one inclined surface 56 provided inside main container 10 above duct 20, and which is sloped generally downwards with respect to duct 20 to direct ball 78 into duct 20 via gravity. In one embodiment, duct 20 may be a rectangular duct centered between two opposing side edges of main container 10. Main container 10 may further include 2 inclined surfaces 56 each sloped downwards from one of the side edges to a corresponding top edge of duct 20 to funnel ball 78 into duct 20, wherein ball 78 is then conveyed into ball return channel 10B.

In embodiments, ball return channel 10B extends out of a channel slot 18 provided at front wall 11A of main container 10. In some embodiments, ball return channel 10B may be configured to collapse or fold into a compact unit that may be tucked within duct 20 of main container 10 when ball return device 2 is packed for storage, and to extend or fold out of main container 10 to create an inclined channel designed to direct balls 78 from duct 20 back to the user for game play. In certain embodiments, ball return channel 10B may comprise a plurality of sections in telescoping engagement with one another. In some embodiments, ball return channel 10B may be a rectangular or square ramp including a bottom surface and two side surfaces. In other embodiments, ball return channel 10B may be an enclosed rectangular or square chute including bottom, top, and two side surfaces. It shall be appreciated that ball return channel 10B may have different geometric configures in alternate embodiments, such as circular, oval, etc.

In one embodiment, ball return channel 10B may comprise a first chute section 58 comprising a rectangular tube in slidable engagement with channel slot 18, a second chute section 62 comprising a rectangular tube in slidable engagement with first telescoping chute section 58, a third chute section 66 comprising a rectangular tube in slidable engagement with second chute section 62, a fourth chute section 70 comprising a rectangular tube in slidable engagement with third chute section 66, wherein first chute section 58, second chute section 62, third chute section 66, and fourth chute section 70 are configured to collapse into a nested unit which may be tucked into duct 20. In some embodiments, ball return channel 10 B may include transparent top surfaces comprising a first transparent top 60 in first chute section 58, a second transparent top 64 in second chute section 62, a third transparent top 68 in third chute section 66, and a fourth transparent top 72 in fourth chute section 70. The transparent top surfaces are configured to enable a user to view ball 78 as it rolls down the ramp.

It shall be appreciated that duct 20 and ball return channel 10B may have different configurations and/or added elements in alternate embodiments. For example, duct 20 may be provided with an internal inclined ramp configured to feed balls into ball return channel 10B. In further embodiments, duct 20 and/or the internal inclined ramp may include a connector configured to connect to ball return channel 10B. In certain embodiments, the bottom end of the internal inclined ramp and first chute section 58 may include corresponding connector elements designed to hold ball return channel 10B in place when extended. In such embodiment, first chute section 58 may be the narrowest and longest of the chute sections. In some embodiments, ball return channel 10B may be permanently connected or hinged to main container 10; in other embodiments, it may be removeable.

In embodiments, top catch panels 10A are coupled to the top edge of main container 10 and are configured to catch and direct balls into main container 10. In some embodiments, top catch panels 10A may surround the entire perimeter of main container 10. Additionally, top catch panels 10A are configured to fold out of main container 10 and act as a 360 degree backboard for missed shots. In some embodiments, at least a portion of catch panels 10A may be inclined or sloped downwards from a top panel edge to a top edge of main container. Furthermore, top catch panels are configured to fold flat onto the top of main container 10.

In one embodiment, top catch panels 10A may comprise a front panel 36 including a bottom edge connected to a front top edge of main container 10; side panels 44 each including a bottom edge connected to a respective side top edge of main container 10; and a rear panel 52 including a bottom edge connected to a rear top edge of main container 10, wherein each panel is configured to rotate about its connecting edge. In further embodiments, top catch panels 10A may comprise front corner panels 40 connected between front panel 36 and side panels 44; and rear corner panels 48 integrally connected between rear panel 52 and side panels 54. Together, front panel 36, side panels 44, rear panel 52, front corner panels 40, and rear corner panels 48 form a primary backboard which may be oriented upwards and radially outwards with respect to main container 10 and is self-supported when extended from the main container. Additionally, front panel 36, side panels 44, rear panel 52, front corner panels 40, and rear corner panels 48 may be folded to collapse flat on top of main container 10 and may further form a rectangle or square when folded.

In further embodiments, each of the primary backboard panels may include a panel wing extending from its top edge, wherein front panel 36 may comprise a front panel wing 38 extending from its top edge, side panels 44 may each comprise a side panel wing 46 extending from their respective top edges, rear panel 52 may comprise a rear panel wing 54 extending from its top edge, front corner panels 40 may each comprise a front corner panel wing 42 extending from their respective top edges, and rear corner panels 48 may each comprise a rear corner panel wing 50 extending from their respective top edges. In certain embodiments front panel wing may be transparent. Together, the panel wings form a secondary backboard connected to the top edges of the primary backboard. In certain embodiments, the secondary backboard may be oriented upwards and radially inwards with respect to main container 10 (i.e., facing towards main container 10). In other embodiments, the secondary backboard panels may extend upward in line with the walls of main container 10. Additionally, the panel wings may be folded to collapse flat on top of main container 10 together with the primary backboard panels (see FIGS. 8 and 9).

According to various embodiments, top catch panels 10A may be integrally connected to one another at their respective edges. For example, the panels may comprise cardboard which may be folded to create the connected edges. In other embodiments, hinge elements may be provided to couple the backboards. In one embodiment, a hinge element may comprise a flexible sheet which may be adhered to adjacent panels. It shall be appreciated that the panels may be made of various materials, including carboard, plastic, and the like.

In certain embodiments, stand 10C is configured to elevate main container 10 to provide a higher target level and/or set a higher degree of incline for ball return channel 10B. In some embodiments, stand 10C may comprise a box lid 12, which may also serve as a cap for ball return device 2 when the device is packed for storage (see FIG. 12). In one embodiment, box lid 12 may include an opening 12A to assist a user in removing box lid 12 for unpacking device 2. As such, a user may remove box lid 12 from main container 10, place box lid 12 on a substantially flat surface, then place main container on top of box lid 12 for game setup.

It shall be appreciated that different types of stands may be provided in alternate embodiments. For example, main container 10 may comprise bottom legs configured to extend from its bottom surface, which may be placed on any surface for elevating main container 10. In some embodiments, such legs may be provided in addition to box lid 12, wherein main container 10 may be elevated using box lid 12 and the legs which are supported on top of box lid 12. Additionally, box lid 12 may include connectors at its top surface corners designed to hold the bottom legs in place. In some embodiments, the bottom legs may be foldable or telescoping, and main container 10 may be configured to nestle inside the stand when the legs are contracted.

In some further embodiments, ball return device 2 may also include at least one drawer type storage slot 14 for holding balls 78. In one embodiment, storage slot 14 may be a rectangular cutout provided within a side wall 11B of main container 10, wherein inclined surface 56 may form a top wall of the storage slot. In further embodiments, storage slot 14 may be configured to receive a ball drawer 74 designed to hold multiple balls 78. In some embodiments, ball drawer 74 may slide into storage slot 14 to position substantially flush with side wall 11B, and/or may be completely removed from storage slot 14. In further embodiments, ball return device 2 may be configured to store other game components (e.g., scoreboard(s), various components of target 10D, etc.). Such components may also be stored in ball drawer 74, or in another container and/or another storage element within main container 10. In one embodiment, main container 10 may include two drawer type storage slots 14, one on each of the two side walls 11B. In alternate embodiments, main container 10 may include a cup slot 16 which may be a circular cutout for holding a target cup. Such slot may be provided on back wall 11C or side wall 11B opposite storage slot 14. In some embodiments, ball drawer 74 may be used to collect balls 78 as they roll down the ball return channel 10B. To this end, ball drawer 74 may include a ball drawer flap 76 that unfolds to enable balls 78 to easily roll into ball drawer 74 from ball return channel 10B. It shall be appreciated that different types of storage elements may be used in alternate embodiments. For example, a storage tray may be used instead of or in addition to a drawer; or device 2 may incorporate elements such a pockets or pouches for storage of various game components.

Figure 5:
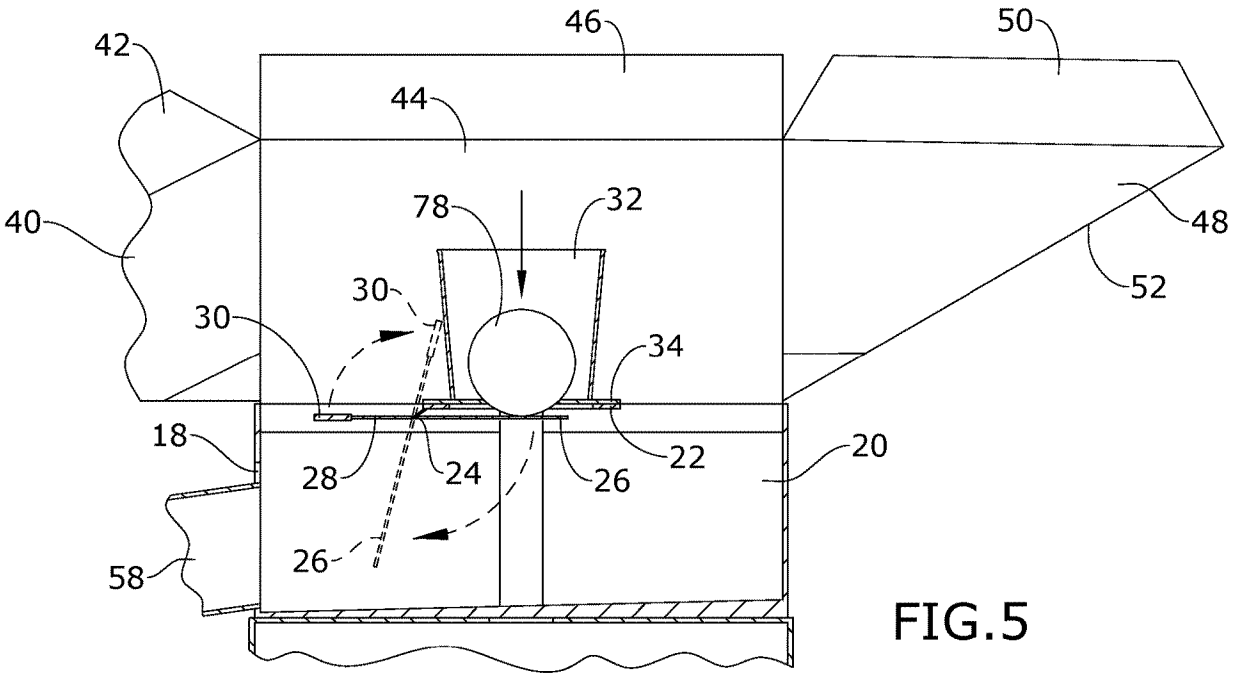
FIG. 5 is a detailed section view of the ball return device, illustrating a ball hitting the target wherein a clapper component of the device is triggered.
Figure 6:
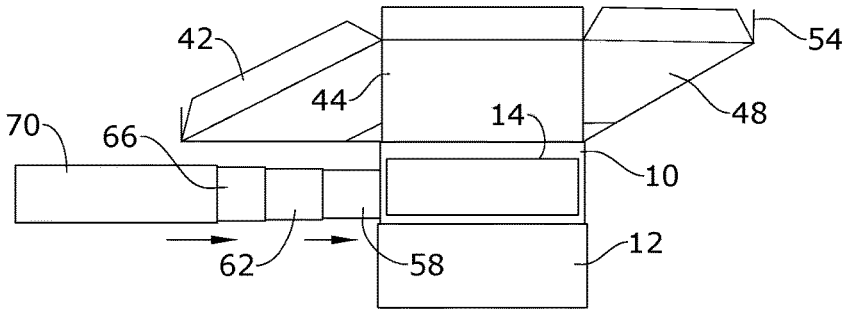
FIG. 6 is a side view of the ball return device, illustrating retraction of the ball return channel.
Figure 7:
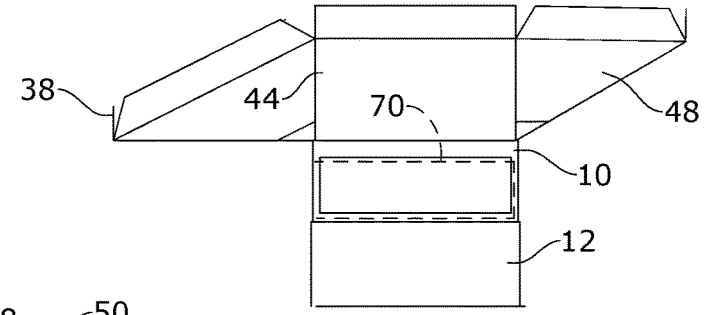
FIG. 7 is a side view of the ball return device, illustrating the ball return channel in a packed configuration.
Figure 8:
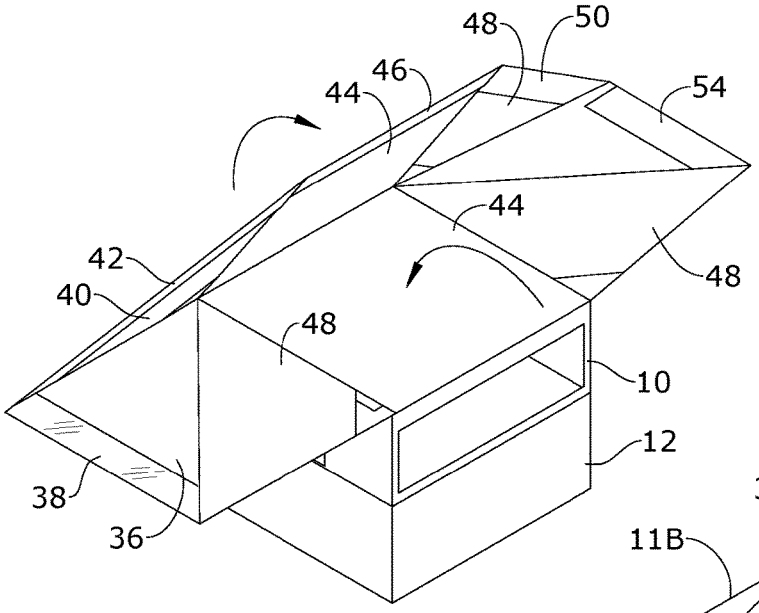
FIG. 8 is a perspective view of the ball return device, illustrating initial steps in packing the device for storage.
Figure 9:
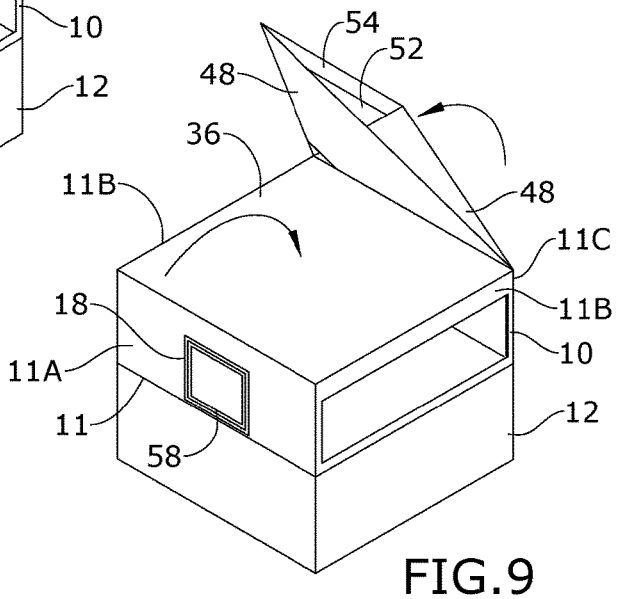
FIG. 9 is a perspective view of the ball return device, illustrating subsequent steps in packing the device for storage.
Figure 10:
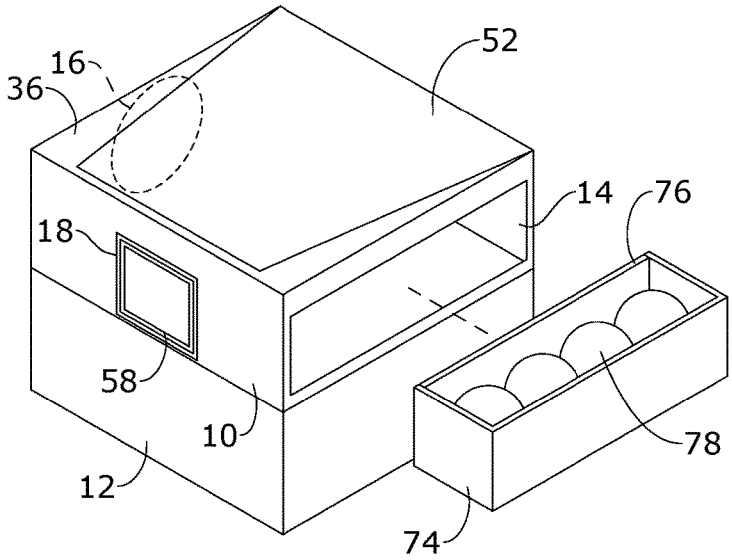
FIG. 10 is a perspective view of the ball return device, illustrating a ball drawer of the device being tucked within a slot of the device for packing the device.
Figure 11:
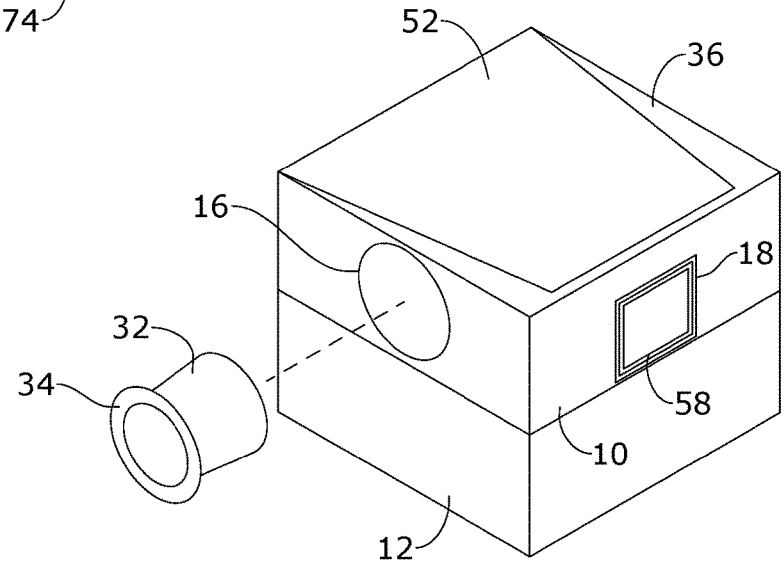
FIG. 11 is a perspective view of the ball return device, illustrating the cup being tucked within a slot for packing the device.
Figure 12:
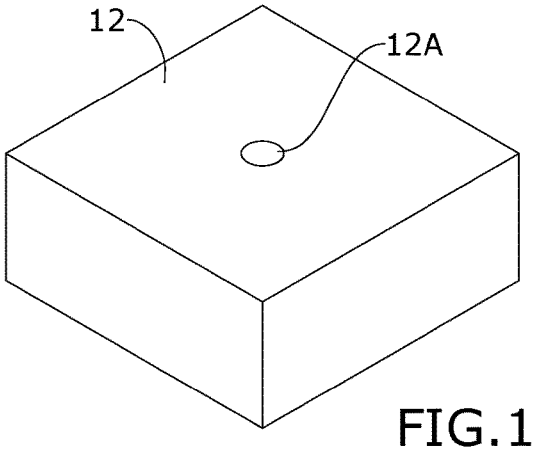
FIG. 12 is a perspective view of the ball return device, illustrating the device in a fully packed and lidded configuration.

In embodiments, target 10D may comprise any object or assembly of objects, which players may try to hit or land with ball 78. Target 10D may include components such as a hoop, cup, bullseye, trigger, and the like. In certain embodiments as best depicted in FIGS. 1-5, target 10D may generally comprise an assembly of objects including at least one cup 32 into which players try to land ball 78 thrown from a distance, and a cup stand 22 on which cup 32 may be supported, wherein cup stand 22 is supported over duct 20. In certain embodiments, cup stand 22 may be held in place via inclined surfaces 56 and/or duct 20 and positions over duct 20. In one embodiment, cup stand 22 may include legs 22A which may be wedged between inclined surfaces 56 or attached to inclined surfaces 56 and/or duct 20 to hold the cup stand in place. In other embodiments, the legs may be telescopic and attached to duct 20, such that the target may be extended upwards for set up and lowered for packing. In further embodiments, cup stand 22 may be a ring and cup 32 may comprise a cup base 34 which extends radially outward from cup 32 and is configured to sit on cup stand 22. Additionally, cup 32 may have a hollow bottom such that a ball 78 which lands inside cup 32 may fall into duct 20 and return via ball return channel 10B. In some embodiments, target 10D may further comprise a bullseye type trigger 26 which may be positioned underneath cup 32 and/or concentric with cup stand 22. In certain embodiments, trigger 26 may be coupled to a pivot arm 28, which may be pivotally coupled to a pivot support member, the pivot support member 24 being coupled to and extending forwards from cup stand 22. In one embodiment, pivot support member 24 may be a bracket comprising a pair of side bars including back ends which are attached to cup stand 22, and a front bar coupled between the two side bars, wherein pivot arm 28 is rotationally supported on the front bar. Additionally, pivot arm 28 may be substantially balanced about its pivot point such that it is approximately leveled with respect to the bottom wall of main container 10. In further embodiments, a clapper 30 may be provided at a front end of pivot arm 28. As shown in FIG. 5, clapper 30 is configured to hit the outside of cup 32 when ball 78 is landed in the cup, thus landing on trigger 26 and causing pivot arm 28 to rotate clapper 30 towards cup 32. This may create a "clapping" sound indicating that the target was successfully hit. As cup 32 has an opened bottom, both the miss and hit balls may be directed to the ball return channel.

It shall be appreciated that that target 10D may comprise different components in alternate embodiments. In some embodiments the bottom of the cup may be closed so that balls which are landed inside the cup remain in the cup. In certain embodiments, target 10D may include multiple cups, which may have open or closed bottoms according to alternate embodiments. In other embodiments, one or more hoops, bullseye triggers, and the like may be used as targets. It shall be appreciated that target 10D may be supported via various components of ball return device 2, including the backboard panels, in alternate embodiments.

Figure 13:
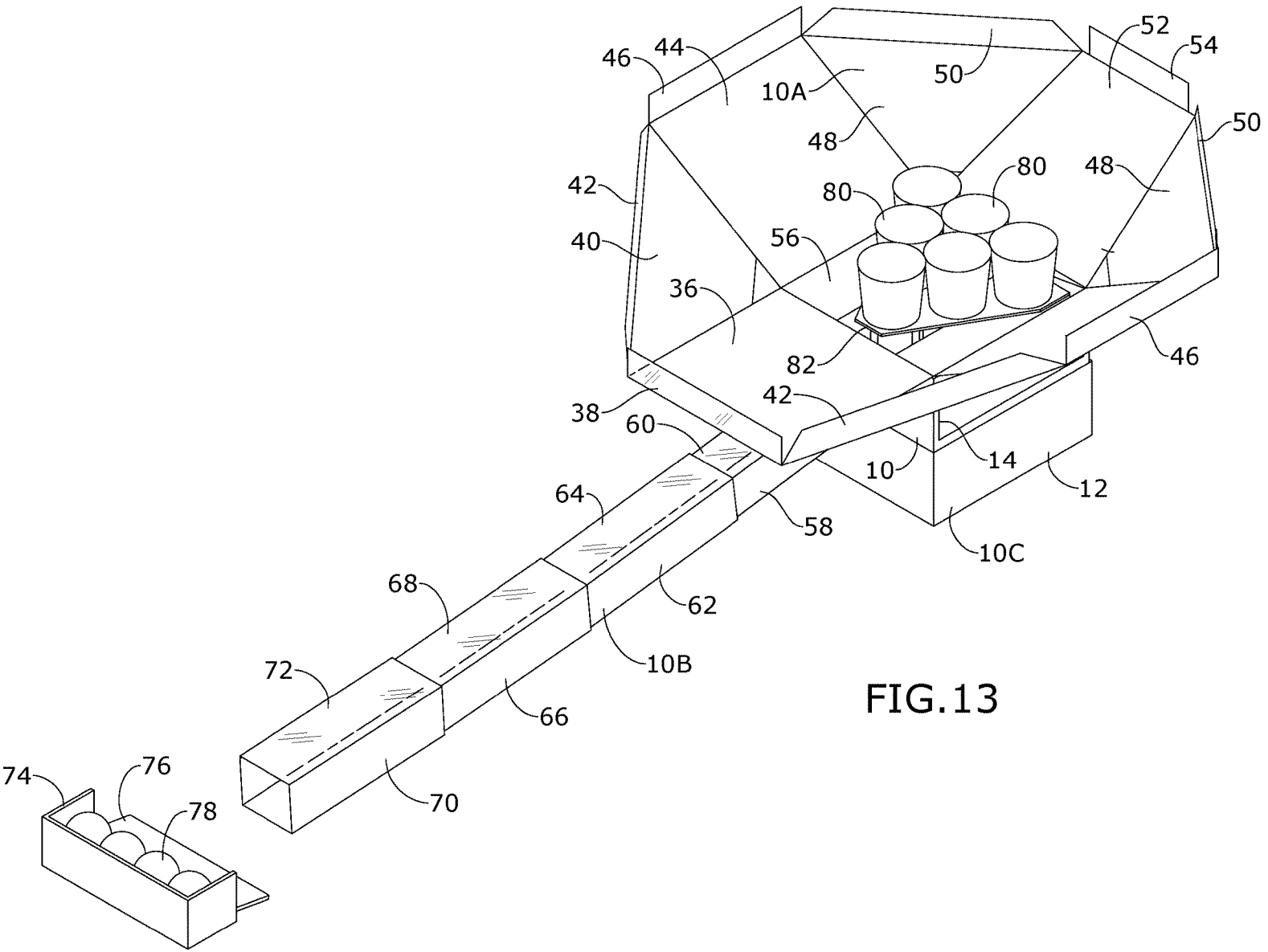
FIG. 13 is a perspective view of the foldable ball return device, including a multi-cup target system according to an alternate embodiment.

FIG. 13 depicts an example of a foldable ball return device 2 wherein target 10D includes multiple cups 80 according to an alternate embodiment. In certain embodiments, multiple cups 80 may be arranged in a triangular configuration and supported on a triangular multi-cup target base 82, as shown in the figure.

Figure 14:
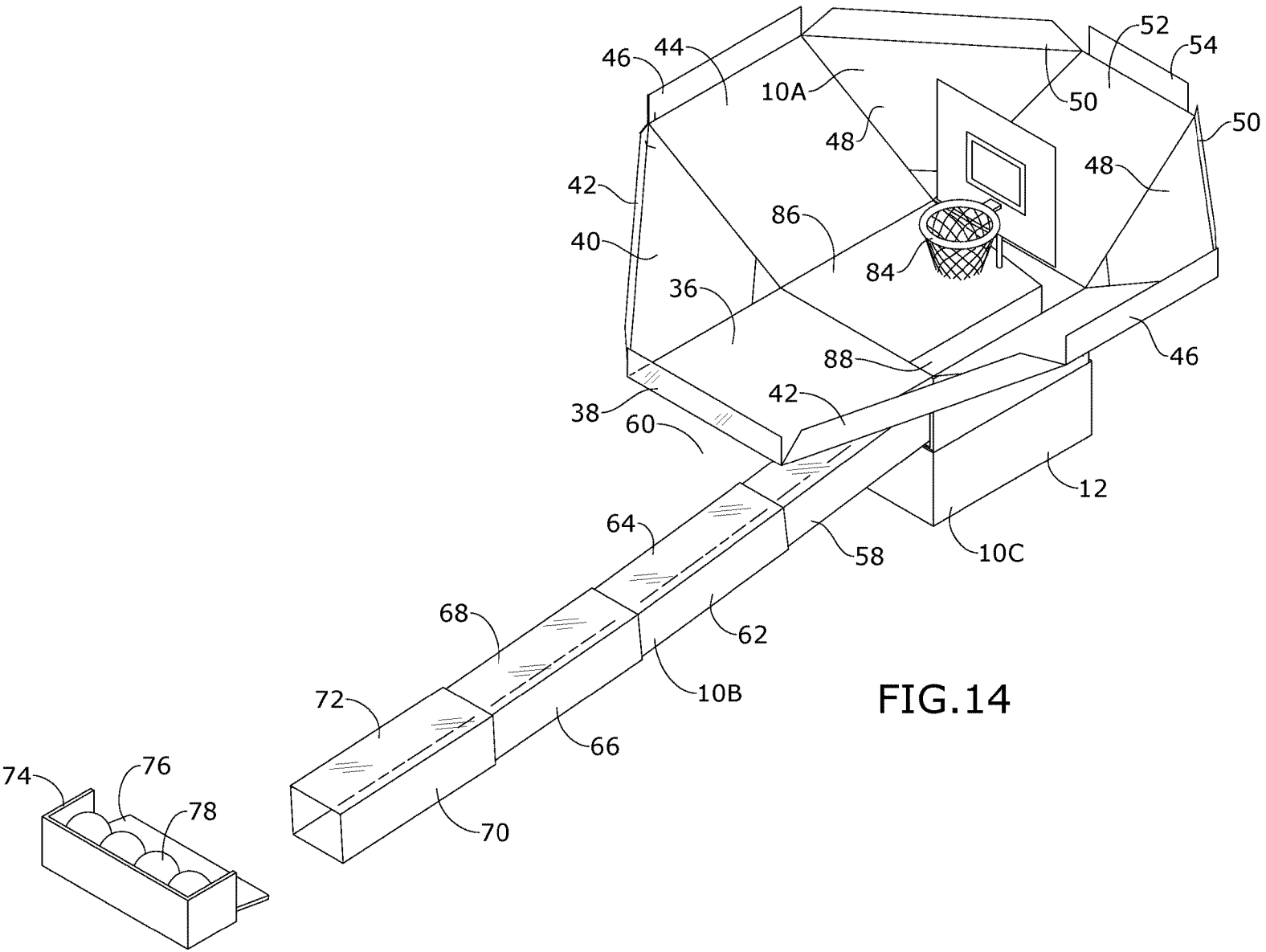
FIG. 14 is a perspective view of the foldable ball return device, including a basketball target system according to an alternate embodiment.

FIG. 14 depicts another example of a foldable ball return device 2 wherein target 10D includes a basketball goal target 84 supported on rear panel 52 according to an alternate embodiment. In this example, ball return channel 10B may be provided at a side of main container 10, wherein an off center inclined surface 86 may funnel balls into a side duct 88 coupled to the ball return channel.

Ball return device 2 may be set up for game play by removing the stand/lid and placing it on any surface which is substantially flat. The main container may then be placed on the lid, the top catch panels 10A unfolded, and the ball return channel 10B extended. The target may then be set up and the stored game equipment, such as balls, scoreboards, etc., may be removed from the main container. Additionally, and the ball drawer may be placed in position to catch the rolled balls. Once play is over, ball return device 2 may be packed by folding catch panels 10A into main container 10, retracting ball return channel 10B into main container 10, placing balls 78 into ball drawer 74 and inserting ball drawer 74 into slot 14, then placing lid 12 over main container 10.

The disclosed device is easily portable, self-contained, and does not require electricity to consistently return balls to the thrower(s). The device can be quickly deployed for practice or play almost anywhere with little set up and cleanup required. It shall be appreciated that the disclosed ball return device 2 can have multiple configurations in different embodiments. In some embodiments, ball return device 2 may omit components such as the stand, secondary backboard, trigger, storage slot, and/or ball drawer. Added functionality may be provided in the form of an electronic scoreboard and/or an electronic sensor instead of a mechanical trigger. In other embodiments, an electronic sensor may trigger lights instead of or in addition to sounds. In further embodiments, an electronic sensor may be in communication with an electronic scoreboard. Additionally, a larger version of the device may be designed for activities such as batting and tennis.

It shall be appreciated that the components of ball return device 2 described in several embodiments herein may comprise any alternative known materials in the field and be of any size and/or dimensions. In embodiments, components of the device may be made of carboard, plastic, metal, etc., and combinations thereof. It shall be appreciated that the components of ball return device 2 described herein may be manufactured and assembled using any known techniques in the field.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A ball return device for a target-style game, the device comprising:

a main container configured to support at least one target;

top catch panels coupled to a top edge of the main container and configured to be selectively folded inwards and outwards from the main container, wherein, when folded outwards, the top catch panels extend upwards and outwards with respect to the main container to create an angled backboard configured to catch and direct a ball thrown at the backboard into the main container; and a ball return channel configured to convey a ball from the main container to a player located remotely from the main container, wherein the ball return device is configured to pack into a compact unit, wherein the main container is in the form of a box or a rectangular prism, and includes vertical walls comprising a front wall, a rear wall, and two side walls extending between the front wall and the rear wall, the top edges of said vertical walls defining top edges of the main container including a front top edge, a rear top edge, and side top edges, wherein, when folded inwards, the top catch panels are configured to fold flat onto the top of the main container and to create a top wall which is perpendicular to the vertical walls of the main container and has a square or rectangular geometry, wherein the top catch panels include two side panels each including a bottom edge connected to a respective side top edge of main container, and a rear panel including a bottom edge connected to the rear top edge of main container, wherein each of the two side panels and rear panel is configured to rotate about its respective connecting edge for being selectively foldable inwards and outwards from the main container, wherein the top catch panels further include a first rear corner panel connected between the rear panel and a first one of the two side panels, and a second rear corner panel connected between the rear panel and a second one of the two side panels.

2. The ball return device of claim 1, wherein the ball return channel is coupled to the main container and is collapsible and extendable with respect to main container.

3. The ball return device of claim 2, wherein the ball return channel is storable within the main container when the ball return channel is collapsed for packing the ball return device.

4. The ball return device of claim 3, further comprising a duct within the main container, and at least one inclined surface above the duct, wherein the inclined surface is configured to convey a ball into the duct, and wherein the duct is configured to convey the ball into the ball return channel when the ball return channel is extended from the main container.

5. The ball return device of claim 1, further comprising a stand configured to support the main container.

6. The ball return device of claim 5, wherein the stand is further configured to function as a lid for packing the ball return device.

7. The ball return device of claim 1, wherein the target is storable within the main container for packing the ball return device.

8. The ball return device of claim 1, wherein the target style game is beer pong, or miniature basketball.

9. The ball return device of claim 1, wherein the target comprises a hoop or a cup.

10. The ball return device of claim 1, wherein the target comprises multiple cups.

11. The ball return device of claim 1, wherein the two side panels and the rear panel are square or rectangular, and wherein the first rear corner panel and the second corner panel are triangular.

12. The ball return device of claim 11, wherein the top catch panels further comprise:

a front panel including a bottom edge connected to the front top edge of main container, the front panel being configured to rotated about its connecting edge; and a first front corner panel connected between the front panel and the first one of the two side panels; and a second front corner panel connected between the front panel and a second one of the two side panels, wherein the front panel is square or rectangular and wherein the first front corner panel and the second front corner panel are each triangular, and wherein the top catch panels are configured to surround the entire perimeter of the main container when folded outwards.

* * * * *